US006434863B1

(12) United States Patent
Meurer

(10) Patent No.: US 6,434,863 B1
(45) Date of Patent: Aug. 20, 2002

(54) EXCAVATOR BUCKET WITH RETRACTABLE SCARIFIER

(76) Inventor: Robert Meurer, 15286 93rd Ave., Chippewa Falls, WI (US) 54729

( * ) Notice: Subject to any disclaimer, the term of this patent is extended or adjusted under 35 U.S.C. 154(b) by 0 days.

(21) Appl. No.: 09/998,171

(22) Filed: Dec. 3, 2001

(51) Int. Cl.[7] ..... E02F 3/96
(52) U.S. Cl. ..... 37/410; 37/903; 414/722
(58) Field of Search ..... 37/403, 404, 405, 37/408, 409, 410, 443, 444, 903; 414/722; 172/815; 299/24, 25

(56) References Cited

U.S. PATENT DOCUMENTS

| | | | | | |
|---|---|---|---|---|---|
| 2,840,931 | A | * | 7/1958 | Appel | 37/117.5 |
| 3,061,123 | A | * | 10/1962 | Rogers | 214/145 |
| 3,430,703 | A | * | 3/1969 | Richey | 172/136 |
| 3,596,996 | A | * | 8/1971 | Carter | 299/10 |
| 3,778,111 | A | * | 12/1973 | Ciofani | 299/67 |
| 3,795,070 | A | * | 3/1974 | Bronson et al. | 37/117.5 |
| 3,959,900 | A | * | 6/1976 | Luck | 37/117.5 |
| 4,038,766 | A | | 8/1977 | Felstet | |
| 4,041,624 | A | | 8/1977 | Fryrear | |
| 4,056,205 | A | | 11/1977 | Etzler, IV | |
| 4,151,664 | A | * | 5/1979 | Maura | 37/117.5 |
| 4,204,348 | A | * | 5/1980 | Lydie | 37/117.5 |
| 4,279,085 | A | | 7/1981 | Arnold | |
| 4,407,080 | A | * | 10/1983 | Mann | 37/117.5 |
| 4,512,090 | A | * | 4/1985 | Billings | 37/117.5 |
| 4,517,755 | A | * | 5/1985 | Nicholson | 37/117.5 |
| 4,595,240 | A | | 6/1986 | Pettersson | |
| 4,967,850 | A | | 11/1990 | Bargfrede et al. | |
| 5,115,583 | A | * | 5/1992 | Vail | 37/103 |
| 5,456,028 | A | * | 10/1995 | Larson | 37/404 |
| 6,023,863 | A | * | 2/2000 | Mahin | 37/404 |
| 6,257,342 | B1 | * | 7/2001 | Szatko | 172/21 |
| 6,311,417 | B1 | * | 11/2001 | Pratt | 37/404 |

FOREIGN PATENT DOCUMENTS

| | | | | |
|---|---|---|---|---|
| GB | 2191465 | * | 6/1986 | E02F/3/60 |
| JP | 62-233346 | * | 10/1987 | E02F/3/355 |

* cited by examiner

*Primary Examiner*—Thomas B. Will
*Assistant Examiner*—Kristine Markovich
(74) *Attorney, Agent, or Firm*—Manelli Denison & Selter; Edward J. Sternberger

(57) ABSTRACT

A combined bucket and scarifier device includes a bucket having a bottom wall, a rear wall, and two side walls coupled to the bottom wall and the rear wall to define an interior space. The bucket has an open front end and a generally smooth lower front edge. The bottom wall includes a plurality of openings therethrough. A scarifier is operatively associated with the bucket. The scarifier has a plurality of teeth constructed and arranged to be movable with respect to the bucket between an inoperative position within the interior space so as not to obstruct the lower front edge and the bottom wall of the bucket, to an operative position with portions of the teeth extending through the openings in the bottom wall of the bucket. An actuating structure is mounted with respect to the bucket to move the teeth between the inoperative and operative positions.

14 Claims, 3 Drawing Sheets

EXCAVATOR BUCKET WITH RETRACTABLE SCARIFIER

FIELD OF THE INVENTION

This invention relates to excavator buckets, more specifically, to an excavator bucket including a retractable scarifier useful in breaking-up and leveling ground when attached to a skid steer loader or the like.

BACKGROUND OF THE INVENTION

All-wheel drive skid-steer loaders have gained in popularity due to their compact size and maneuverability. The conventional skid-steer loaders are configured so that a variety of separate attachments can be coupled thereto such as an excavator bucket, a scarifier, a dozer blade, etc.

Oftentimes when using a skid-steer loader with a bucket attachment, it is necessary to break-up hard ground. Thus, an operator is required to stop the operation of the loader and physically remove the bucket to put on a scarifier having teeth to breakup compacted or hard ground. Many operators find this to be a great loss in work time and often choose to just break-up the ground with the bucket, thus creating additional costs and loss of time to repair/replace the misused equipment.

There are conventional buckets having teeth that protrude from the lower front edge of the bucket. These buckets work well when digging and ground-breaking are needed but, because the teeth are permanently fixed to the front edge of the bucket, the teeth hinder the process of smoothing and packing soil because the points of the teeth leave lines in the ground during back-dragging of the bucket.

Accordingly, there is a need to provide a bucket including a retractable scarifier so that the bucket can be used without obstruction from the scarifier when the scarifier is not required, and so that the scarifier can be employed when needed to break-up hard ground.

SUMMARY OF THE INVENTION

An object of the invention is to fulfill the need referred to above. In accordance with the principles of the present invention, this objective is obtained by providing a combined bucket and scarifier device including a bucket having a bottom wall, a rear wall, and two side walls coupled to the bottom wall and the rear wall to define an interior space. The bucket has an open front end and a generally smooth lower front edge. The bottom wall includes a plurality of openings therethrough. A scarifier is operatively associated with the bucket. The scarifier has a plurality of teeth constructed and arranged to be movable with respect to the bucket between an inoperative position within the interior space so as not to obstruct the smooth lower front edge and bottom wall of the bucket, to an operative position with portions of the teeth extending through the openings in the bottom wall of the bucket. An actuating structure is mounted with respect to the bucket to move the teeth between the inoperative and operative positions thereof.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE PREFERRED EXEMPLARY EMBODIMENT

Figure 1:
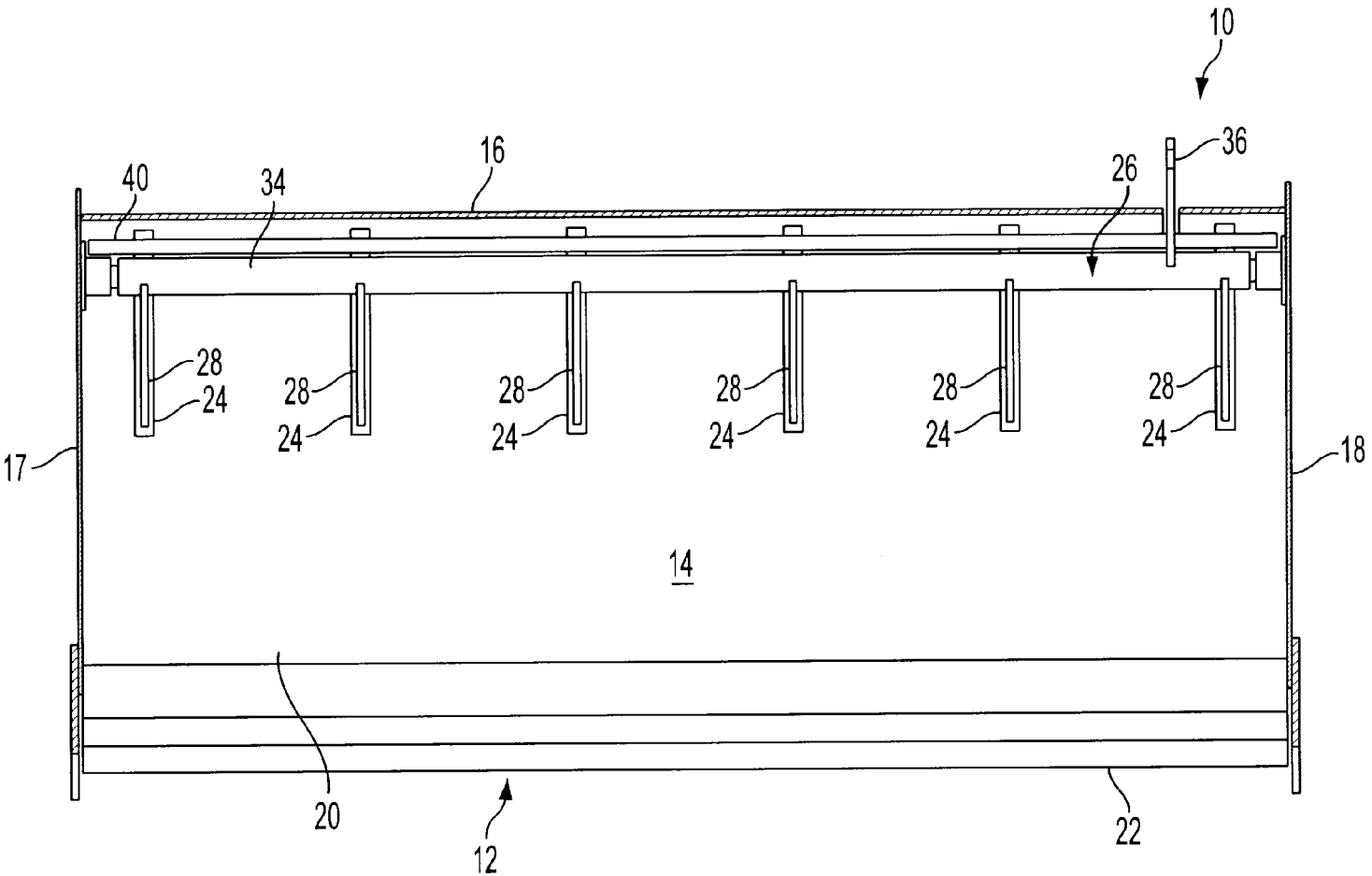
FIG. 1 is a plan view of a device providing a combined bucket and scarifier in accordance with the principles of the present invention, shown without the hydraulic cylinder attached.

With reference to FIG. 1, a device providing a combined bucket and scarifier in accordance with the invention is shown generally indicated at 10. The device 10 is constructed and arranged to be attached to, for example, a conventional skid-steer loader such as the type manufactured by the Melroe Company under the name Bobcat®.

The device 10 includes a bucket, generally indicated at 12, for use in loading trucks, smoothing the ground by back-dragging, etc. The bucket 12 has a generally planar bottom wall 14, a rear wall 16, a left side wall 17 and a right side wall 18 coupled to the bottom wall 14 and the rear wall 16 to define an interior space 20 for containing soil or the like. The bucket 12 has open front end for access to the interior space 20, and a generally smooth lower front edge 22, (e.g., there are no serrations or teeth at the lower front edge 22). In the illustrated embodiment, the bottom wall 14 of the bucket is of generally rectangular shape and includes a plurality of openings 24 spaced along a length of the bottom wall 14.

Figure 2:
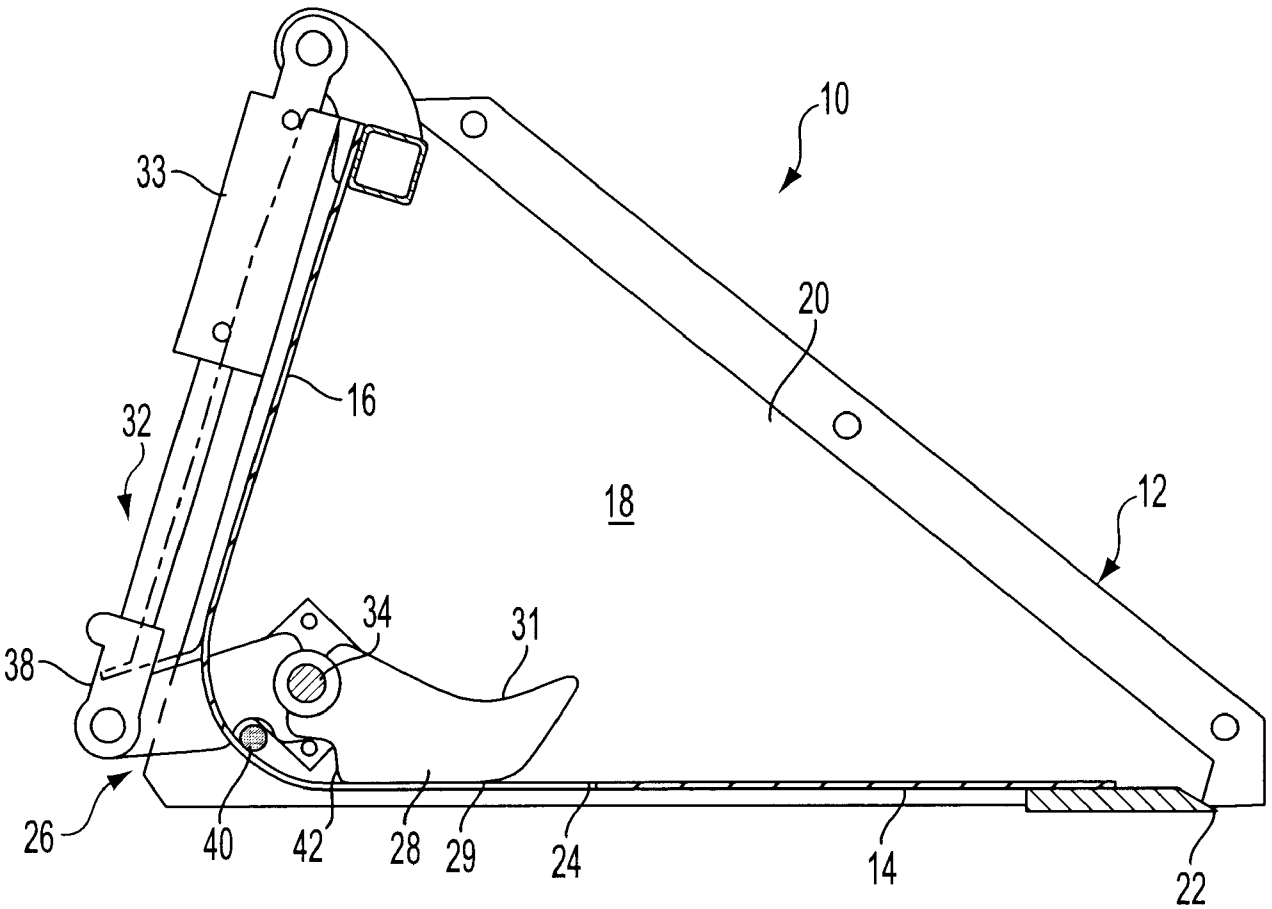
FIG. 2 is a side view of the device of FIG. 1 shown, partially in section, with the scarifier in a retracted, inoperative position.
Figure 3:
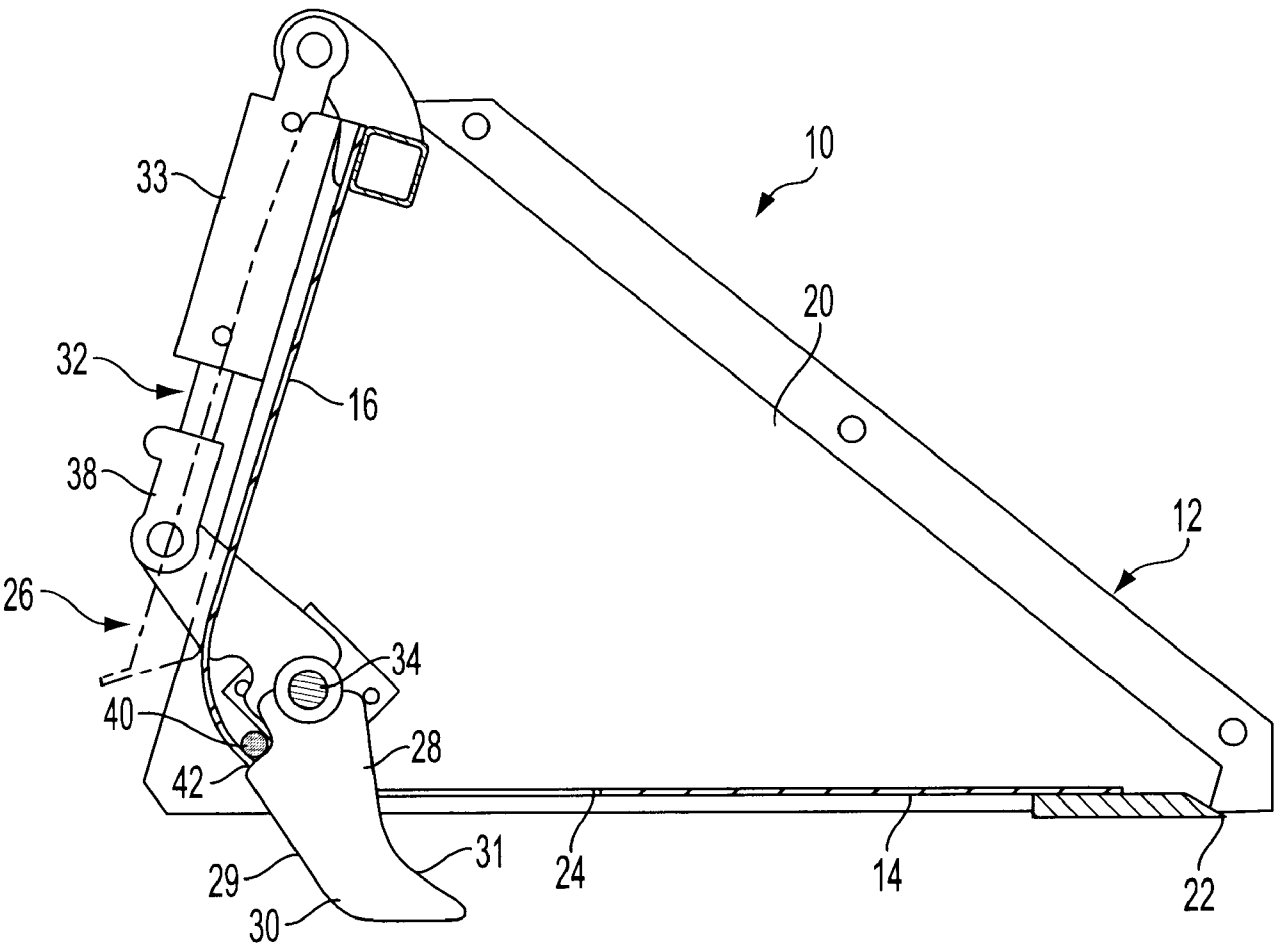
FIG. 3 is a side view of the device of FIG. 1 shown, partially in section, with the scarifier in an extended, operative position.

The device 10 also includes a scarifier, generally indicated at 26, operatively associated with the bucket 12. The scarifier 26 includes a plurality of teeth 28 constructed and arranged to be movable with respect to the bucket 12 between a retracted, inoperative position (FIG. 2) within the interior space 20 so as not to obstruct the smooth lower front edge 22 and bottom wall 14 of the bucket 12, to an extended, operative position (FIG. 3) with portions 30 of the teeth 28 extending through the openings 24 in the bottom wall 14 of the bucket 12. Each tooth 28 is associated with an opening 24 in the bucket 12. In the illustrated embodiment, the openings 24 are near the rear wall 16 of the bucket 12 such that the portions 30 of the teeth 28 extend through the bottom wall 14 of the bucket generally adjacent to the rear wall 16 when in the operative position thereof, and the teeth 28 are generally adjacent to the rear wall 16 within the interior space 20 when in the inoperative position thereof. It is preferable that the teeth 28 be entirely within the bucket 12 in the inoperative position thereof so as to not provide an obstruction when only the bucket is being employed. In that regard, each tooth 28 has a generally planar edge 29 which is substantially parallel with the bottom wall when in the inoperative position. Each tooth 28 also has a curved edge 31 opposite the planar edge 29.

The device 10 includes an actuating structure, generally indicated at 32, mounted with respect to the bucket 12 and constructed and arranged to rotate the teeth 28 simultaneously to move the teeth between the inoperative and operative positions. In the embodiment, the actuating structure 32 includes at least one hydraulic cylinder 33 that is mounted to the rear wall 16 of the bucket 12 and is constructed and arranged to be fluidly coupled to the hydraulics of the conventional skid steer loader. The teeth 28 are coupled to a common rotatable shaft 34. The actuating structure 32 includes a linkage 36 at one end of the bucket 12 coupled at one end thereof to the shaft 34 and rotatably coupled at the other end thereof to a piston 38 of the hydraulic cylinder 33. Extension and retraction of the piston 38 rotates the linkage 36 and thus the shaft 34 to move the teeth 28 between the operative and inoperative positions. It can be appreciated that a hydraulic cylinder and linkage can be provided near each end of the bucket 12 and operated by a common hydraulic line of the vehicle to which the bucket is attached.

A second shaft 40 is fixed to the bucket 12 and defines a stop to engage a stop surface 42 of each tooth 28 to limit the movement of the teeth in the operative position.

The teeth 28 are controlled by a lever from inside the cab of the skid-steer which controls the application of hydraulic fluid to the hydraulic cylinder(s) 33. When the teeth 28 are not in use, they are contained within the bucket 12 so as not to interfere with the normal use of the bucket 12. When the teeth 28 are needed to break-up the hard, packed ground, the operator would only need to operate the lever to lower the teeth 28. The depth of engagement of the teeth 28 with the ground is limited by the underside of the bucket (bottom wall 14).

Since the smooth edge 22 and the bottom wall 14 of the bucket 12 are unobstructed by the scarifier 26 in normal use of the bucket and since the teeth 28 of the scarifier 26 can be lowered when needed, the loss of time for equipment changes can be reduced or eliminated along with repairs needed due to misuse of the bucket to break-up ground.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A device providing a combined bucket and scarifier comprising:

a bucket having a bottom wall, a rear wall, and two side walls coupled to the bottom wall and the rear wall to define an interior space, the bucket having an open front end and a generally smooth lower front edge, the bottom wall including a plurality of openings therethrough, a scarifier operatively associated with the bucket, the scarifier having a plurality of teeth constructed and arranged to be movable with respect to the bucket between an inoperative position within the interior space so as not to obstruct the lower front edge and the bottom wall of the bucket, and an operative position with portions of the teeth extending through the openings in the bottom wall of the bucket, and an actuating structure mounted with respect to the bucket and being constructed and arranged to move the teeth between the inoperative and operative positions.

2. The device of claim 1, wherein each of the teeth has a planar edge which is generally parallel with the bottom wall when in the inoperative position, and a curved edge opposite the planar edge.

3. The device of claim 1, wherein the openings are generally adjacent to the rear wall of the bucket such that the portions of the teeth extend through the bottom wall of the bucket near the rear wall in the operative position thereof, and the teeth are generally adjacent to the rear wall entirely within the interior space in the inoperative position thereof.

4. The device of claim 1, wherein the actuating structure is constructed and arranged to rotate the teeth simultaneously to move the teeth between the inoperative and operative positions.

5. The device of claim 4, wherein the actuating structure includes at least one hydraulic cylinder mounted to the rear wall of the bucket.

6. The device of claim 5, wherein the teeth are coupled to a common shaft, the actuating structure including a linkage between the shaft and a piston of the at least one hydraulic cylinder such that movement of the piston rotates the linkage and thus the shaft to move the teeth between the operative and inoperative positions.

7. The device of claim 1, wherein the bottom wall is of generally rectangular shape and the openings are spaced along a length of the bottom wall.

8. The device of claim 1, further comprising a shaft coupled to the bucket and defining a stop constructed and arranged to engage a stop surface of each of the teeth when the scarifier is in the operative position.

9. A device providing a combined bucket and scarifier comprising:

a bucket having a generally planar bottom wall, a rear wall, and two side walls coupled to the bottom wall and the rear wall to define an interior space, the bucket having an open front end and a generally smooth lower front edge, the bottom wall including a plurality of openings therethrough generally adjacent to the rear wall of the bucket, a scarifier operatively associated with the bucket, the scarifier having a plurality of teeth constructed and arranged to be movable with respect to the bucket between an inoperative position within the interior space so as not to obstruct the lower front edge and bottom wall of the bucket, and an operative position with portions of the teeth extending through the openings in the bottom wall of the bucket, and at least one hydraulic cylinder and linkage mounted with respect to the bucket and constructed and arranged to rotate the teeth simultaneously to move the teeth between the inoperative and operative positions.

10. The device of claim 9, wherein the teeth are coupled to a common shaft, the linkage coupling the shaft and a piston of the at least one hydraulic cylinder such that movement of the piston rotates the linkage and thus the shaft to move the teeth between the operative and inoperative positions.

11. The device of claim 9, wherein the bottom wall is of generally rectangular shape and the openings are spaced along a length of the bottom wall.

12. The device of claim 9, wherein the at least one hydraulic cylinder is mounted to the rear wall of the bucket.

13. The device of claim 9, further comprising a shaft coupled to the bucket and defining a stop constructed and arranged to engage a stop surface of each of the teeth when the scarifier is in the operative position.

14. The device of claim 9, wherein each of the teeth has a planar edge which is generally parallel with the bottom wall when in the inoperative position, and a curved edge opposite the planar edge.

* * * * *